US010137346B1

(12) United States Patent
Williams

(10) Patent No.: US 10,137,346 B1
(45) Date of Patent: Nov. 27, 2018

(54) BALL PITCHING TRAINING DEVICE

(71) Applicant: Claybon Williams, Smyrna, TN (US)

(72) Inventor: Claybon Williams, Smyrna, TN (US)

(73) Assignee: Claybon Williams, Smyrna, TN (US)

( * ) Notice: Subject to any disclaimer, the term of this patent is extended or adjusted under 35 U.S.C. 154(b) by 0 days.

(21) Appl. No.: 15/840,334

(22) Filed: Dec. 13, 2017

(51) Int. Cl.
*A63B 69/00* (2006.01)

(52) U.S. Cl.
CPC ..... *A63B 69/0002* (2013.01); *A63B 69/002* (2013.01); *A63B 2069/0006* (2013.01)

(58) Field of Classification Search
CPC ..... A63B 69/00; A63B 69/38; A63B 67/20
See application file for complete search history.

(56) References Cited

U.S. PATENT DOCUMENTS 7,217,202 B2 5/2007 Troxell
7,374,502 B2 5/2008 Comello, Jr.
7,976,414 B2 7/2011 McKay

*Primary Examiner* — Gene Kim
*Assistant Examiner* — Christopher Glenn
(74) *Attorney, Agent, or Firm* — Tarley Stevenson

(57) ABSTRACT

A ball pitching training device including a flexible inner rod with a handle disposed on a bottom end and an adjustable connection head protruding from a top end. Adjustment apertures are vertically aligned on the connection head. A support cushion encircles a portion of the inner rod. A body strap is disposed on the inner rod by a pair of rings. An adjustment clip is disposed on the body strap and adjusts a length of the body strap. An attachable ball comprises a resistance band, a circular attachment clip, and a baseball. The attachment clip attaches the resistance band and baseball to the connection head by engaging one of the adjustment apertures. A user wears the body strap, securing the device, grasps the baseball and simulates a throwing movement. The resistance band and flexible inner rod provide resistance against the movement and promote muscle growth and proper throwing form.

7 Claims, 3 Drawing Sheets

BALL PITCHING TRAINING DEVICE

BACKGROUND OF THE INVENTION

Various types of pitching training devices are known in the prior art. However, what is needed is a ball pitching training device that provides a means of improving muscle strength and throwing technique. A flexible, fiberglass rod in combination with a resistance band connected to a baseball allows a user to build muscle tone, while the diagonal placement of the device across the user's back encourages the user to throw the ball across the body. A handle is provided for the user to hold the device in place while he throws the ball.

FIELD OF THE INVENTION

The present invention relates to ball pitching training devices for softball or baseball players. The invention is provided to teach proper throwing techniques while also strengthening the user's throwing arm through resistance training.

SUMMARY OF THE INVENTION

The general purpose of the present ball pitching training device, described subsequently in greater detail, is to provide a ball pitching training device which has many novel features that result in a ball pitching training device which is not anticipated, rendered obvious, suggested, or even implied by prior art, either alone or in combination thereof.

To accomplish this, the present ball pitching training device includes a flexible, cylindrical inner rod, preferably made of fiberglass. The inner rod has a top end and a bottom end with a handle disposed on the bottom end. An ovular adjustable connection head, having an exterior edge and an interior edge, protrudes from the top end at the interior edge. A plurality of circular adjustment apertures is vertically aligned on the connection head, extending from a position proximal the exterior edge to a position proximal the interior edge.

A foam support cushion is centrally disposed and encircles a portion on the inner rod. A body strap is attachably disposed on the inner rod by a pair of rings that are disposed on a respective first end and a second end of the body strap. The body strap is provided to allow a user to wear the device. An adjustment clip is disposed on the body strap and is configured to adjust a length of the body strap, allowing a user to secure the body strap.

The device includes an attachable ball comprising a resistance band, having a clip attachment portion and a ball attachment portion, a circular attachment clip disposed on the clip attachment portion, and a throwing ball disposed on the ball attachment portion of the resistance band. It is envisioned that the throwing ball can comprise any type of ball commonly used in sporting games including, but not limited to, a football and a baseball.

Once the user has secured the device, the user grasps the throwing ball and simulates a throwing movement. The resistance band and flexible inner rod provide resistance against the throwing movement and thus, increase strength in the user's throwing arm and promoting proper baseball throwing form. The attachment clip is configured to engage one of the plurality of apertures which either increases resistance or decreases resistance relative to which one of the plurality of adjustment apertures the attachment clip engages.

Thus has been broadly outlined the more important features of the present ball pitching training device so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
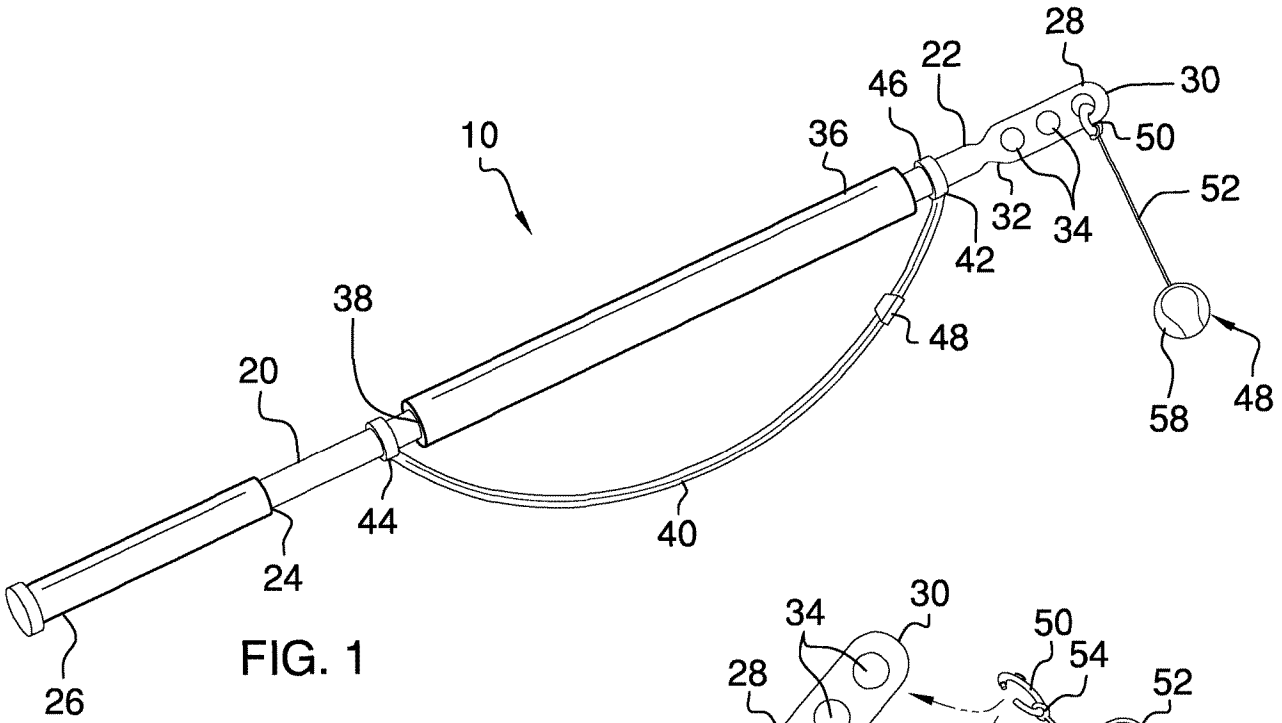
FIG. 1 is a top isometric view.
Figure 2:
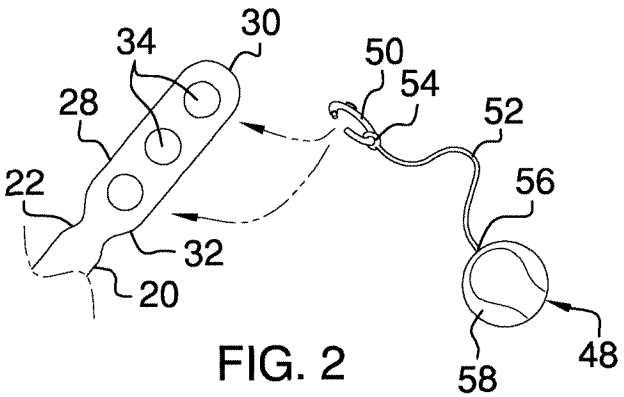
FIG. 2 is a detail view showing the attachment of the attachable ball to the adjustment head.
Figure 3:
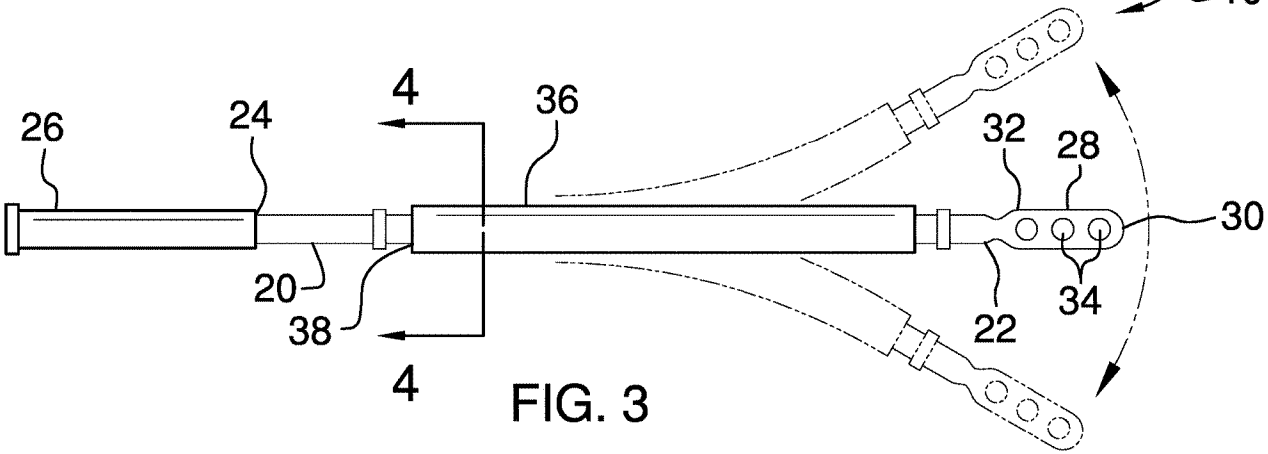
FIG. 3 is a top view.
Figure 4:
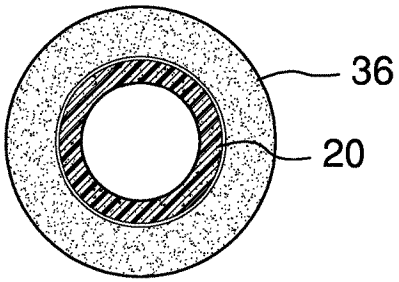
FIG. 4 is a cross-sectional view taken along line 4-4 of FIG. 3.
Figure 5:
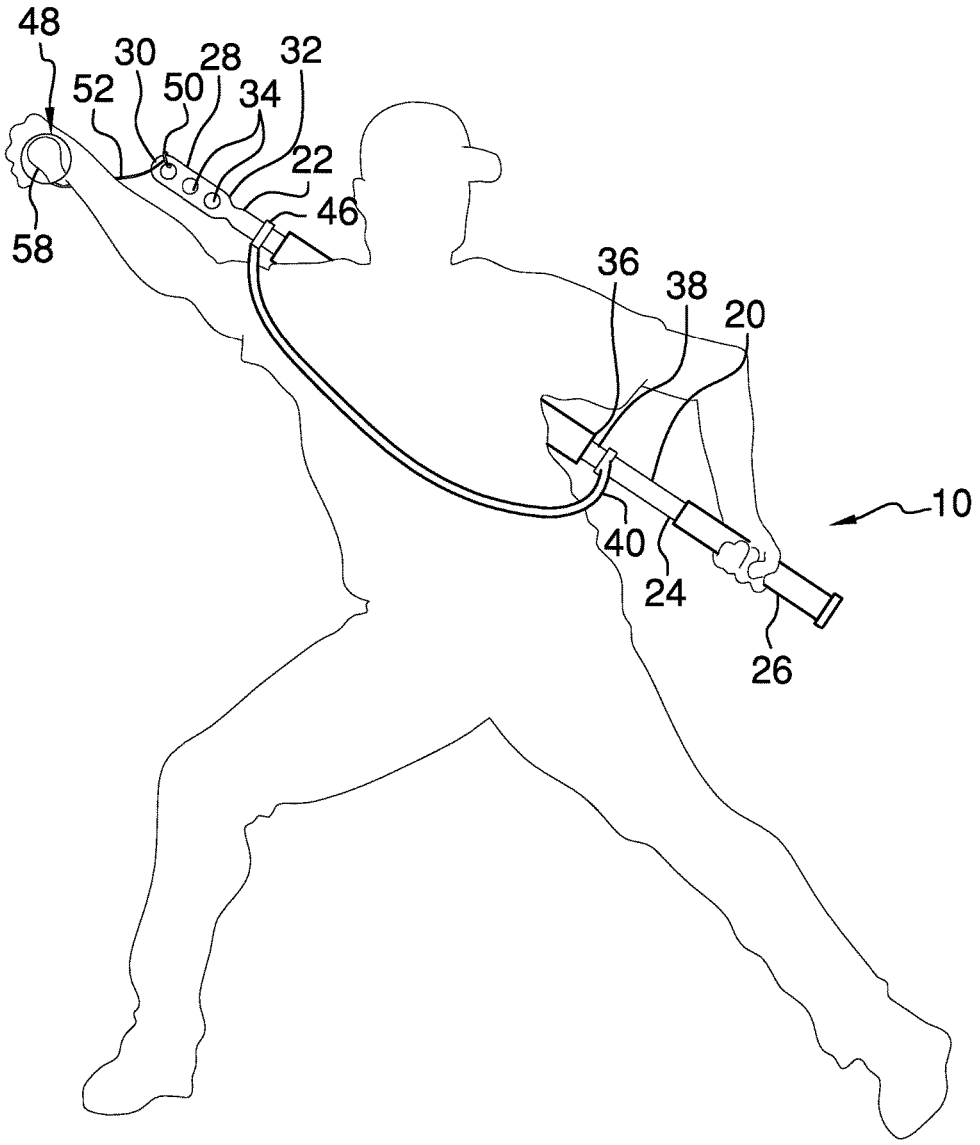
FIG. 5 is an in-use view.

With reference now to the drawings, and in particular FIGS. 1 through 5 thereof, an example of the instant ball pitching training device employing the principles and concepts of the present ball pitching training device and generally designated by the reference number 10 will be described.

Referring to FIGS. 1 through 5 of the present ball pitching training device 10 is illustrated. The ball pitching training device 10 includes a flexible, cylindrical, fiberglass inner rod 20. The inner rod 20 has a top end 22 and a bottom end 24. A handle 26 is linearly disposed on the bottom end 24. An ovular adjustable connection head 28 protrudes from the top end 22. The adjustable connection head 28 has a rounded exterior edge 30 and a rounded interior edge 32. The connection head 28 is attached to the top end 22 at the interior edge 32. A plurality of circular adjustment apertures 34 is vertically aligned on the connection head 28, extending from a position proximal the exterior edge 30 to a position proximal the interior edge 32.

A foam support cushion 36 is centrally disposed on the inner rod 20, encircling a portion 38 of the inner rod 20. A body strap 40 is attachably disposed on the inner rod 20. The body strap 40 has a first end 42, a second end 44 and a pair of rings 46. One of the pair of rings 46 is attached to a respective one of the first end 42 and the second end 44. The rings 46 are provided to secure the body strap 40 to the inner rod 20. An adjustment clip 48 is disposed on the body strap 40 and is configured to adjust a length of the body strap 40.

An attachable ball 48 is provided for pitching training. The attachable ball 48 comprises a circular attachment clip 50 and a resistance band 52. The resistance band 50 has a clip attachment portion 54, on which the attachment clip 50 is disposed, and a ball attachment portion 56. A throwing ball 58 is disposed on the ball attachment portion 56 of the resistance band 52. The attachment clip 50 is configured to engage one of the plurality of apertures 34. The body strap 40 is provided for a user to secure the device 10 on the user's body.

Once the user has secured the device 10, the user grasps the throwing ball 58 and simulates a throwing movement. The resistance band 52 and flexible inner rod 20 provide resistance against the throwing movement and thus, increase strength in the user's throwing arm and promoting proper baseball throwing form. The plurality of adjustment apertures 34 are provided to either increase resistance of the resistance band 52 or decrease resistance of the resistance band 52 relative to which one of the plurality of adjustment apertures 34 the attachment clip 50 engages.

What is claimed is:

1. A ball pitching training device comprising:

a flexible cylindrical inner rod having a top end and a bottom end;

a handle disposed on the bottom end;

an adjustable connection head protruding from the top end, the connection head having an exterior edge and an interior edge, wherein the connection head is attached to the top end at the interior edge;

a plurality of adjustment apertures vertically aligned on the connection head, the plurality of adjustment apertures extending from a position proximal the exterior edge to a position proximal the interior edge;

a support cushion centrally disposed and encircling a portion of the inner rod;

a body strap attachably disposed on the inner rod, the body strap having a first end and a second end, the body strap having a pair of rings, wherein one of the pair of rings is attached to a respective one of the first end and the second end, wherein the rings secure the body strap to the inner rod;

an adjustment clip disposed on the body strap, the adjustment clip being configured to adjust a length of the body strap; and an attachable ball comprising:

a resistance band having a clip attachment portion and a ball attachment portion;

a circular attachment clip disposed on the clip attachment portion; and a throwing ball disposed on the ball attachment portion of the resistance band;

wherein the attachment clip is configured to engage one of the plurality of apertures, wherein a user wears the body strap to secure the device on the user's body, wherein the user grasps the throwing ball and simulates a throwing movement, wherein the resistance band and flexible inner rod provide resistance against the throwing movement.

2. The ball pitching training device of claim 1, wherein the inner rod is fiberglass.

3. The ball pitching training device of claim 1, wherein the support cushion is foam.

4. The ball pitching training device of claim 1, wherein the apertures are circular.

5. The ball pitching training device of claim 1, wherein the adjustment head is ovular.

6. The ball pitching training device of claim 1, wherein the throwing ball is a baseball.

7. A ball pitching training device comprising: a flexible cylindrical fiberglass inner rod having a top end and a bottom end; a handle linearly disposed on the bottom end; an ovular adjustable connection head protruding from the top end, the connection head having a rounded exterior edge and a rounded interior edge, wherein the connection head is attached to the top end at the interior edge; a plurality of circular adjustment apertures vertically aligned on the connection head, the plurality of adjustment apertures extending from a position proximal the exterior edge to a position proximal the interior edge; a foam support cushion centrally disposed and encircling a portion of the inner rod; a body strap attachably disposed on the inner rod, the body strap having a first end and a second end, the body strap having a pair of rings, wherein one of the pair of rings is attached to a respective one of the first end and the second end, wherein the rings secure the body strap to the inner rod; an adjustment clip disposed on the body strap, the adjustment clip being configured to adjust a length of the body strap; and an attachable ball comprising: a resistance band having a clip attachment portion and a ball attachment portion; a circular attachment clip disposed on the clip attachment portion; and a baseball disposed on the ball attachment portion of the resistance band; wherein the attachment clip is configured to engage one of the plurality of apertures, wherein a user wears the body strap to secure the device on the user's body, wherein the user grasps the baseball and simulates a throwing movement, wherein the resistance band and flexible inner rod provide resistance against the throwing movement.

* * * * *